United States Patent [19]

Griffin

[11] Patent Number: 4,629,143

[45] Date of Patent: Dec. 16, 1986

[54] ROTATING SLASHER CREEL

[75] Inventor: Everett Griffin, High Point, N.C.

[73] Assignee: Burlington Industries, Inc., Greensboro, N.C.

[21] Appl. No.: 771,043

[22] Filed: Aug. 30, 1985

[51] Int. Cl.[4] ..... B65H 49/18

[52] U.S. Cl. ..... 242/131; 28/193; 104/23.1; 211/59.2; 211/150; 211/151; 414/276; 414/911

[58] Field of Search ..... 242/131, 131.1, 130, 242/129.5, 35.5 R; 28/193; 211/150, 151, 59.2; 414/276, 911, 676; 104/23 FS, 134; 180/124, 125

[56] References Cited

U.S. PATENT DOCUMENTS

| | | | |
|---|---|---|---|
| 2,013,770 | 9/1935 | Stein et al. | 242/131.1 |
| 2,332,005 | 10/1943 | Nystrom et al. | 242/131 |
| 3,251,178 | 5/1966 | Stirling . | |
| 3,499,539 | 3/1970 | Fisher | 211/59.2 |
| 3,568,951 | 3/1971 | Neuburger . | |
| 3,610,364 | 10/1971 | Snoeyenbos . | |
| 3,820,467 | 6/1974 | Burdick | 104/23 FS |
| 3,828,884 | 8/1974 | Burdick | 414/676 X |
| 4,019,700 | 4/1977 | King | 242/131.1 |
| 4,082,195 | 4/1978 | Wnek . | |
| 4,191,296 | 3/1980 | Morgan | 211/59.2 |
| 4,484,435 | 11/1984 | Fritjof . | |
| 4,489,903 | 12/1984 | Titzer | 242/131 |
| 4,515,328 | 5/1985 | Payne . | |
| 4,579,320 | 4/1986 | Gladish | 104/23 FS X |

FOREIGN PATENT DOCUMENTS

| | | | |
|---|---|---|---|
| 1597493 | 8/1970 | France | 242/131 |
| 760918 | 11/1956 | United Kingdom | 28/193 |
| 2031811 | 4/1980 | United Kingdom | 242/131 |

OTHER PUBLICATIONS

"Airfloat", Series A Air Bearings, Airfloat Corporation, Bulletin No. AF-1016.

"SailRail", Air Flow Rack Systems, Lyon Systems Group.

*Primary Examiner*—Stanley N. Gilreath

*Attorney, Agent, or Firm*—Nixon & Vanderhye

[57] ABSTRACT

A creel assembly and section beam pallet minimize downtime, enhance loading and unloading operations and facilitate automation, in slasher, dyeing, and like textile operations. First and second creels are mounted side-by-side on a frame. Air bearings lift the frame off of the floor, and a powered wheel rotates the frame 180°, when changing over from the section beams on one creel, to the other. The section beam pallets include outwardly extending arms having shoes on their bottoms. The shoes cooperate with rails associated with the support frame, and air is delivered between the rails and the pallet shoes when it is desired to move the pallets along the rails. The rails are tilted from a level position to a slightly downwardly inclined position so that the pallets glide on air to the end of the rails, at which position they may be unloaded with a forklift or an automated guided vehicle.

22 Claims, 15 Drawing Figures

Fig. 6
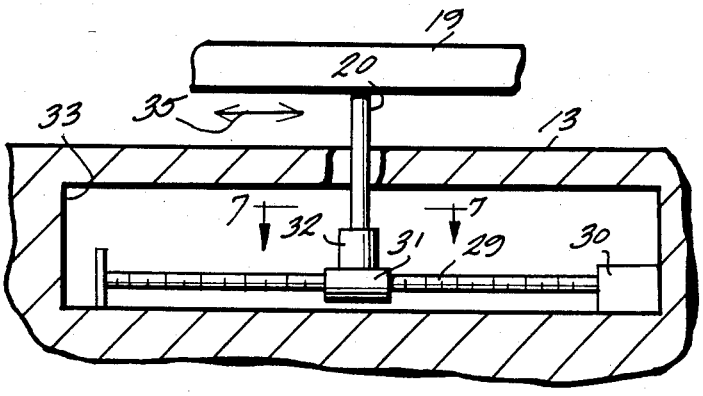
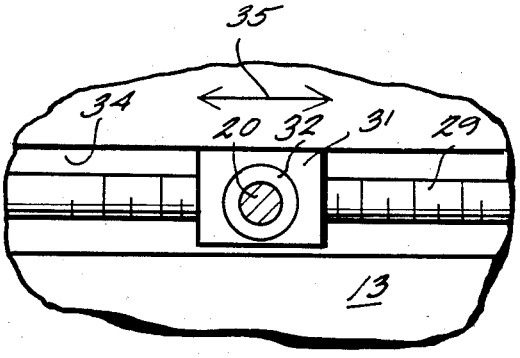
Fig. 7
Fig. 8
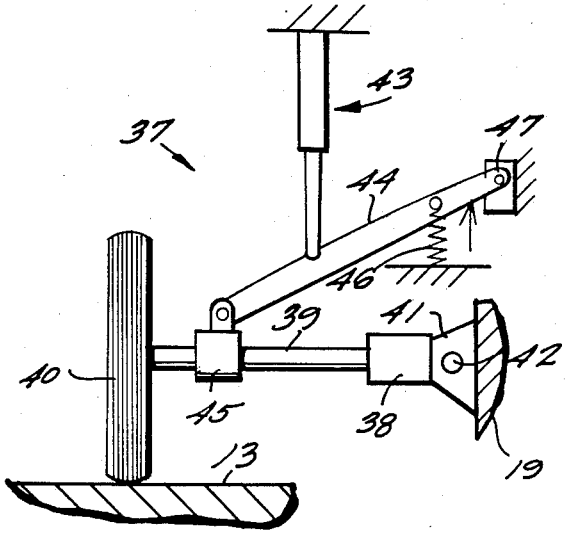
Fig. 9
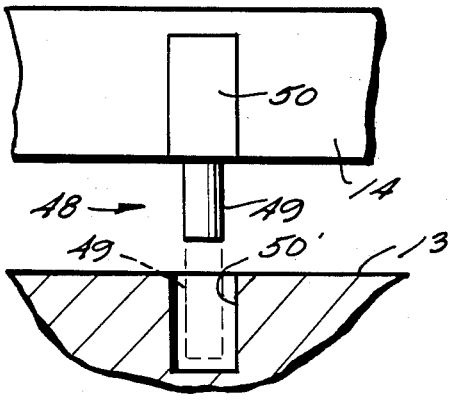

ROTATING SLASHER CREEL

BACKGROUND AND SUMMARY OF THE INVENTION

In many textile processes, such as slashing, denim operations where sheet dyeing operations are performed with indigo dye, and the like, a plurality of section beams supply sheets of yarn to equipment for acting on the yarn. Creel assemblies are provided for mounting the section beams, and when the section beams run out of yarn, it is necessary to stop the slasher (or other piece of equipment), unload and load the creel assembly with new section beams, and then continue running. Prior art procedures have as disadvantages associated therewith an undesirably large amount of downtime, difficulties associated with the loading and unloading operations, and the necessity for manual operation for most of the procedures.

According to the present invention, a creel assembly, and a section beam pallet for use with a creel assembly, are provided that substantially overcome problems inherent in prior procedures and with prior art apparatus. Downtime is reduced since the creel assembly includes first and second creels disposed in side-by-side relationship. While one of the creels is being utilized, the other creel can be unloaded and loaded so that it is ready by the time the first creel is exhausted. Then, according to the present invention, air bearings are utilized for lifting the supporting frame for the creels off the floor, the creels are rotated 180° about a vertical axis at a center point thereof (as by utilizing a powered wheel mounted on a peripheral portion of the frame), and then the second creel is in operative association with the slasher, or like yarn utilization equipment. Thus the changeover from one creel to the other may take as little as three minutes.

Loading and unloading of the creels is also facilitated according to the present invention by the particular construction of creel components, and the particular section beam pallet according to the invention. Each creel comprises sets of pairs of rails. The rails are pivotally mounted at one of their ends to an end of the creel with which they are associated, for pivotal movement about a horizontal axis. Powered components mounted on the frame can pivot the rails about their axis so that they may assume a level (truly horizontal) position, or may slope downwardly from their pivoted end. Air delivery means are provided for supplying air under pressure to the top surfaces of the rails so that they can cooperate with shoes on the section beam pallets to provide for ready sliding movement of the section beam pallets down the rails when they are sloped downwardly. The section beam pallets are unloaded from the opposite end of the creel as the end to which the rails are pivotally attached.

The section beam pallets according to the present invention include a frame supporting the section beam for rotation about a horizontal axis, the frame including first and second side members. The side members each include arms extending generally parallel to the horizontal axis of rotation of the section beam, and are elongated in a horizontal direction generally perpendicular to the horizontal axis. At the bottom of the arms are pallet shoe means, which are also elongated in the same dimension as the arms, and which cooperate with the rails mounted on the creel assembly. The arms above the shoe means are preferably formed as hollow tubes for receipt of tines of a forklift, or an automated guided vehicle.

Automation of the entire creeling operation is facilitated according to the present invention since the components for supplying air between the shoes and rails, the components for tilting the rails, the air bearing means, and the vehicles (automated guided vehicles) for unloading and loading the pallet, can all be operated by a central controller.

It is the primary object of the present invention to provide an apparatus and method for facilitating creeling operations in textile procedures. This and other objects of the invention will become clear from an inspection of the detailed description, and from the appended claims.

BRIEF DESCRIPTION OF THE DRAWINGS

FIG. 6 is a schematic side view, partly in cross-section and partly in elevation, of exemplary apparatus for linearly moving the creel assemblies according to the present invention;

FIG. 7 is a cross-sectional view taken along lines 7—7 of FIG. 6;

FIG. 8 is a side schematic view of exemplary powered rotating means associated with a creel assembly according to the present invention;

FIG. 9 is a side view, partly in cross-section and partly in elevation, of an exemplary latching pin means associated with the creel assembly according to the present invention;

DETAILED DESCRIPTION

Figure 1:
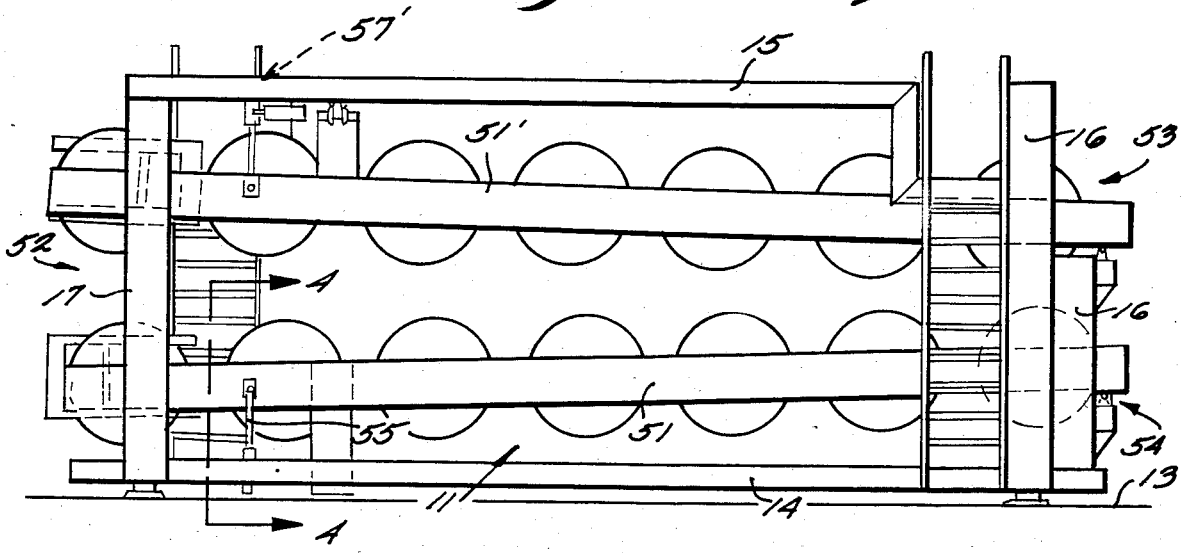
FIG. 1 is a side view, partly in cross-section and partly in elevation, of an exemplary creel assembly according to the present invention, mounting a plurality of section beam pallets according to the invention.
Figure 2:
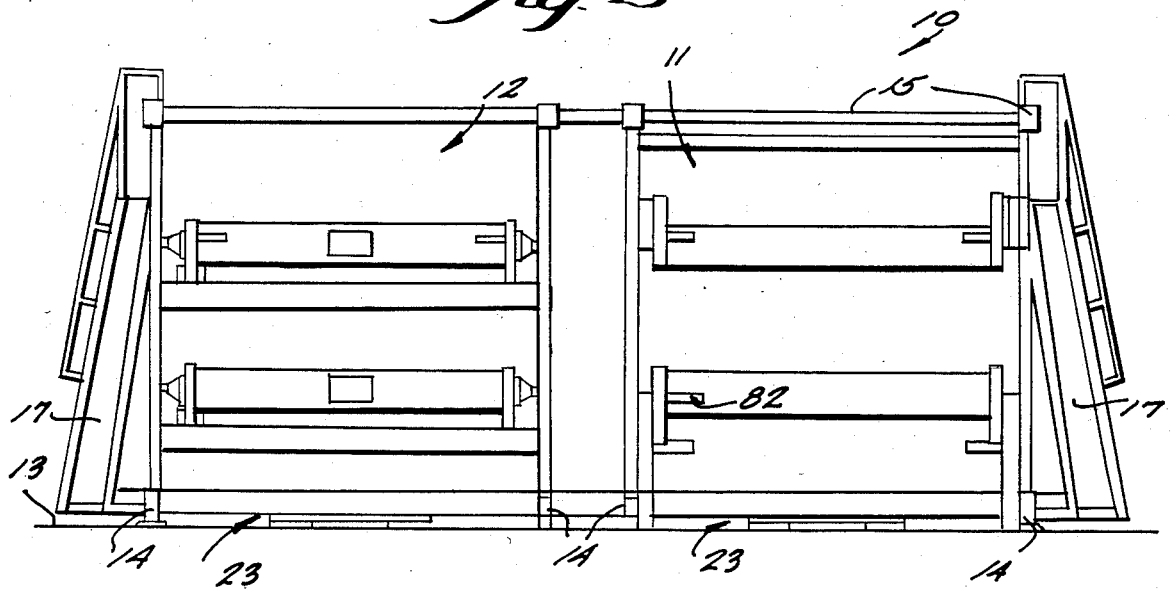
FIG. 2 is an end view of the assembly of FIG. 1 looking in on the left-hand side thereof, with the section beam pallets removed for clarity of illustration.
Figure 3:
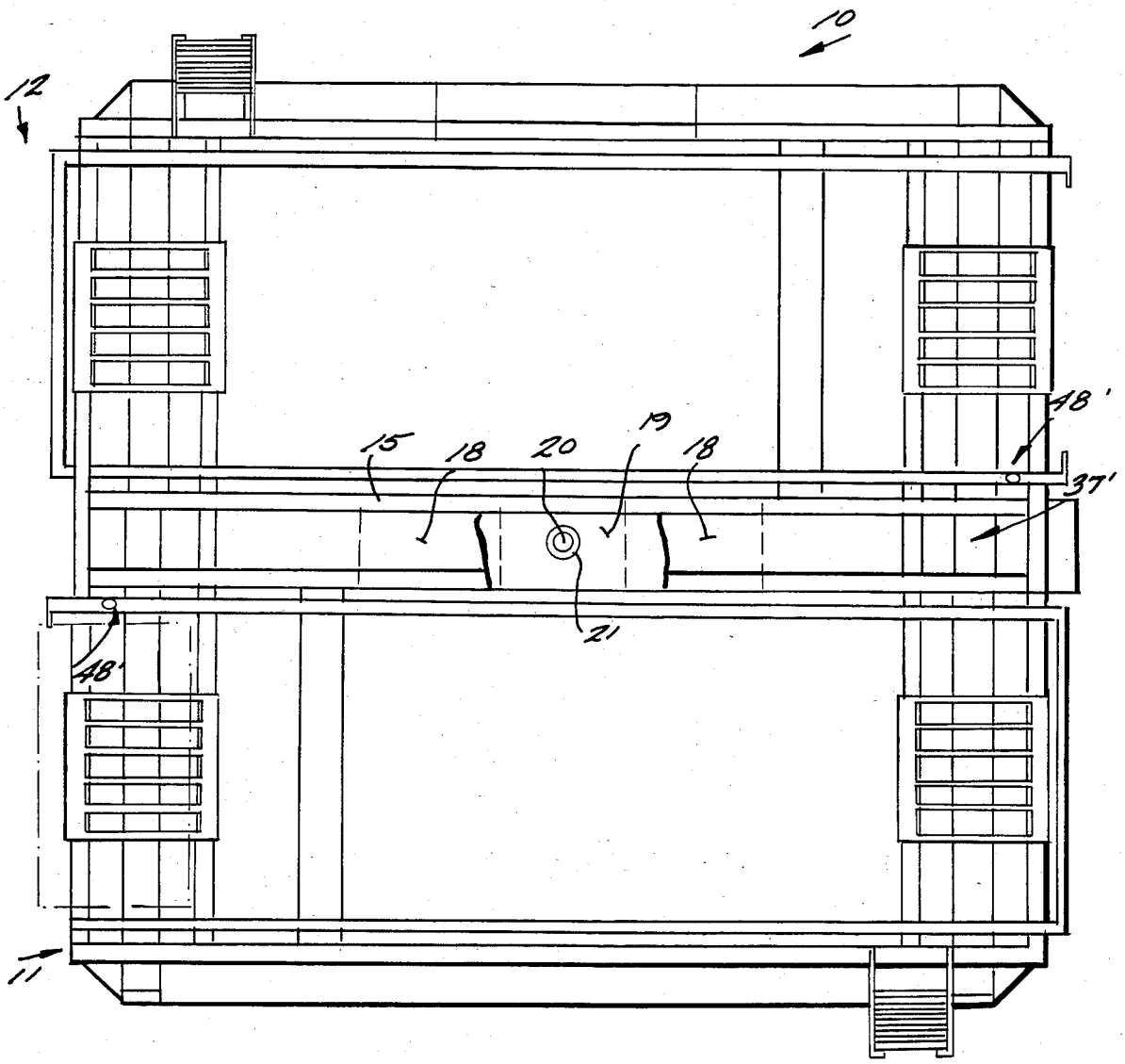
FIG. 3 is a top plan view of the assembly of FIG. 2.

An exemplary creel assembly according to the present invention is shown generally by reference numeral 10 in FIGS. 1 through 3 and 5. As seen most clearly in FIGS. 2, 3 and 5, the creel assembly 10 includes first and second creels 11, 12 mounted in side-by-side relationship, and supported on a floor surface 13. Supporting frame means support the creels in side-by-side relationship, the supporting frame means including bottom beams 14, top beams 15, rear uprights 16, and front uprights 17. Whatever supporting structures are necessary are provided including, for example, upper walk plates 18 spanning the upper beams 15, and lower plates 19 spanning the lower beams 14 at a central section of the creel assembly 10 (see FIG. 3). Disposed at the center of the assembly 10, associated with a plate 19, is rotatable pin 20, received within bearing 21. A wide variety of other components, such as walkways, stairways, and accessory supports, may also be provided as part of the supporting frame means.

The creel assembly 10 also comprises air bearing means for lifting the supporting frame means off of the floor 13, and positioning it for rotation about a vertical axis disposed at the center of the frame means. The vertical axis of rotation is defined by the rotatable pin 20. Preferably four air bearing means 23 are provided spaced equally around the bottom of the frame means, operatively connected to the bottom beams 14. The air bearing means may be of the type such as manufactured by Airfloat Corporation of Decatur, Ill., and known as "Series A air bearings", or such as shown in U.S. Pat. No. 3,610,364, and therefore are not shown in detail in the drawings.

While in some installations there is sufficient room associated with the creel assemblies so that they may be easily rotated about the axis defined by pin 20 without impacting building structural components, or the slasher or other machines with which they are associated, in some installations it is necessary to linearly move the creel assembly 10 before it is in a position where it can be rotated about the pin 20. For instance with reference to FIG. 5, the right-handmost creel assembly 10 in use is positioned so that the left-handmost creel thereof (first creel 11) is in alignment with the slasher 25. However, in this position if it were rotated it would impact support beam 26 of the building. Therefore, it is necessary to linearly horizontally move the creel assembly 10 so that the center thereof, 20, is at the center of the dotted line circle indicated by reference numeral 27 in FIG. 5. Then rotation about the vertical axis defined by pin 20 may be effected.

An exemplary structure for moving the creel assembly 10 linearly is illustrated in FIGS. 6 and 7. The structure comprises a conventional lead screw 29 or the like which is driven by an electric motor 30 or the like, and has a traveling nut 31 associated therewith. The traveling nut 31 also, as is conventional, engages a guide rod (not shown) parallel to the lead screw 29. The rotatable pin 20 is journalled in a bearing 32 mounted to the lead screw 31, and in the bearing 21 mounted in plate 19. The entire mechanism 29, 30, 31 is mounted in a chamber 33 below the floor 13, a slot 34 providing communication between the chamber 33 and the environment above the floor 13, and the pin 20 moving through the slot 34 during its travel. Upon rotation of the lead screw 29, the pin 20 is thus translated back and forth in the horizontal linear dimension indicated by arrows 35, the creel assembly 10 connected to the plate 19 being thus movable between a position wherein it is operatively disposed with respect to the slasher 25 (as illustrated in FIG. 5), and a position in which it is centrally disposed with respect to the circle 27, and thus rotatable about the vertical axis defined by pin 20.

A wide variety of suitable structures may be utilized for rotating the creel assembly 10 about the axis defined by pin 20 once the creel assembly 10 is at the center of the circle 27. One exemplary such means is illustrated schematically in FIG. 8, and is indicated generally by reference numeral 37. The structure 37 may be positioned at any suitable place on the frame supporting means for the creel assembly 10 that is spaced from the pin 20, one suitable position being generally illustrated by the reference numeral 37' in FIG. 3.

The powered rotating means 37 includes an air motor 38 which rotates shaft 39 and wheel 40 connected to shaft 39. The motor 38 is pivotally mounted by gusset 41 and pivot pin 42 to a portion of the frame supporting means of the creel assembly 10, such as a portion of the bottom plate 19, as illustrated schematically in FIG. 8. When the wheel 40 is in the position illustrated in FIG. 8, rotation of the shaft 39 by the motor 38 causes the wheel 40 to rotate and the entire creel assembly 10 to be rotated about the axis defined by pin 20. Once rotation of 180° about that axis is completed, the wheel 40 is moved into an inoperative position. This is accomplished by releasing the air to the pneumatic cylinder 43 which engages lever 44 and which in turn holds the wheel 40, through bearing 45, in contact with the floor 13. When air pressure from the pneumatic cylinder 43 is released, the spring 46 automatically pivots the lever 44 about the pivot 47 so that it moves upwardly to a position wherein the wheel 40 does not engage the floor 13.

Figure 5:
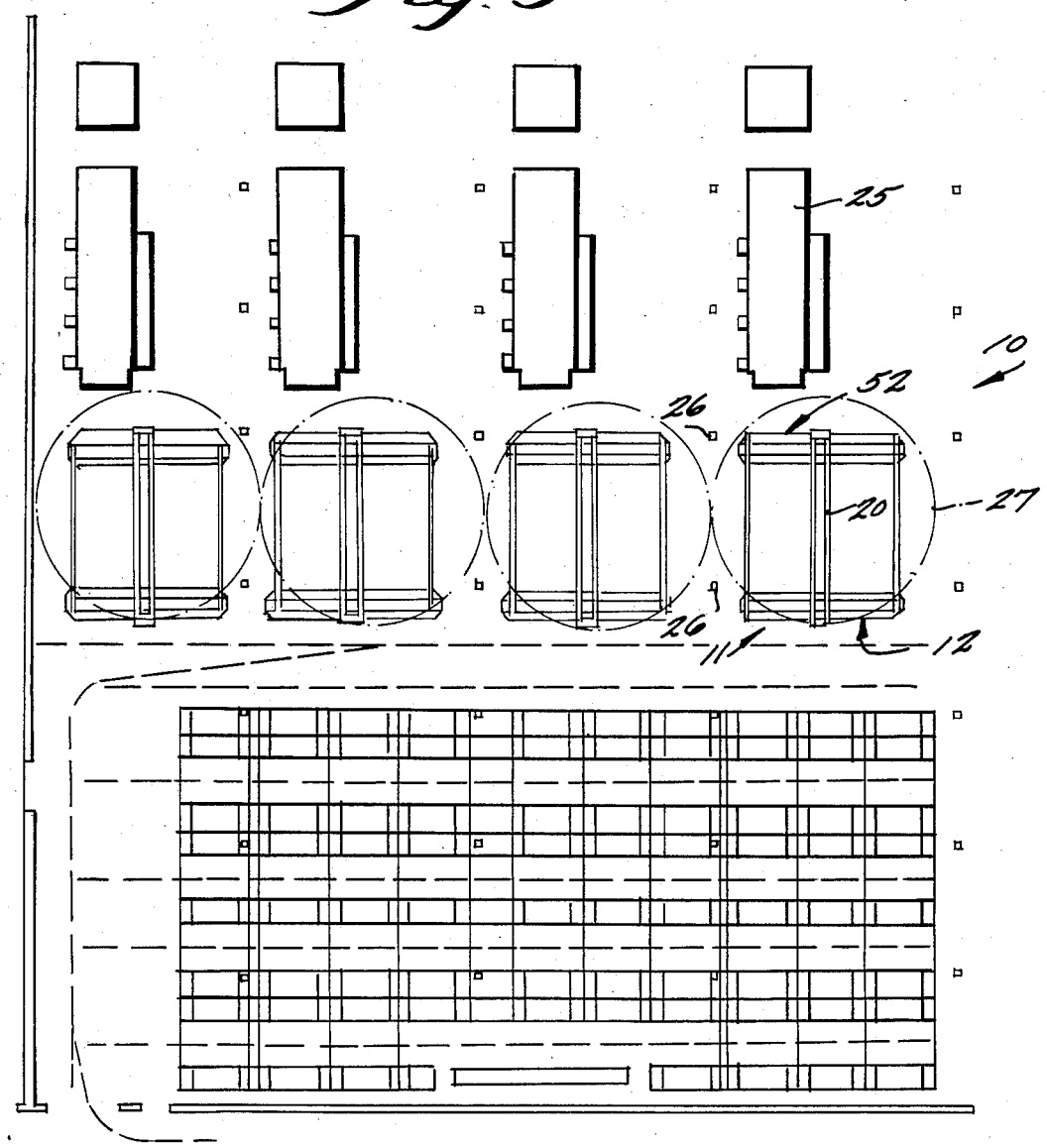
FIG. 5 is top plan schematic view of a slasher facility, illustrating four slashers and four creel assemblies according to the present invention associated therewith.

When the creel assembly 10 is disposed in its operative position with respect to the slasher 25, as illustrated in FIG. 5, it is desirable to lock it in place so that it will not move. This is preferably accomplished utilizing floor pins. See FIG. 9 which schematically illustrates a floor pin 48, one of which is mounted at each of the positions illustrated generally by reference numerals 48' in FIG. 3 at the bottom of the frame supporting means for the creel assembly 10, such as to a bottom beam 14. The floor pin 48 may comprise a retractable metal pin 49 operated by a solenoid 50 which in its retracted position is spaced from the floor 13 (see FIG. 9 solid line position), and when extended (see dotted line position 49 in FIG. 9) extends into a receptacle 50' formed in the floor 13. When pin 49 is in receptable 50', the creel assembly 10 cannot rotate.

The creel assembly 10 also comprises ports for the section beam pallets. Preferably each creel 11, 12 has upper and lower sections, and each section includes a pair of spaced, parallel beams for supporting the section beam pallets. The lower beams for first creel 11 are indicated by reference numeral 51 in FIGS. 1, 2, and 4, and other beams and like components associated with the upper section of creel 11, and both sections of the creel 12, are substantially identical and therefore will not be described in detail.

Loading and unloading of the section beam pallets from the creel 11 takes place at first end 52 thereof. At end 53 thereof, opposite end 52, the beams 51 are mounted for pivotal movement about a horizontal axis by any suitable pivot means, shown generally by reference numeral 54 in FIG. 1. The beams 51 are pivoted by power means about the pivot 54 so that they may assume a level, horizonal position, or may be tilted so that they slope gradually downwardly from end 53 to end 52 (as illustrated in FIG. 1), or slope downwardly from end 52 to end 53. Any suitable pivoting means may be provided, such as the lead screws 55 which are pivotally connected to the beams 51 at one end thereof, and are reciprocated up and down by their engagement with nuts 56, which are rotated by electric motor 57. A wide variety of other suitable mechanisms for moving the beams 51 up and down, adjacent the first end 52 of the first creel 11, may be provided.

Figure 13:
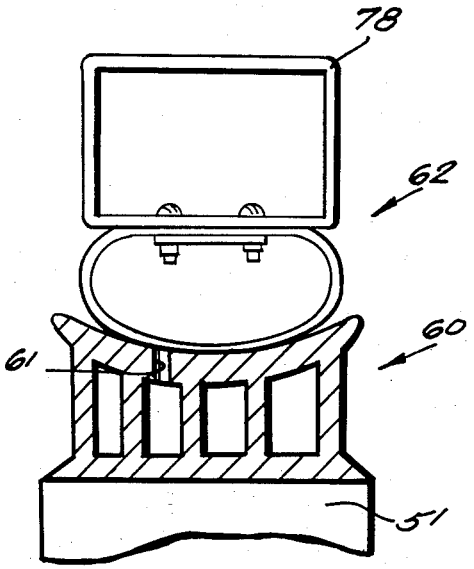
FIG. 13 is a detailed end view, partly in cross-section and partly in elevation, of the shoe of the section beam pallet, and cooperating rail of the creel assembly, according to the present invention.
Figure 14:
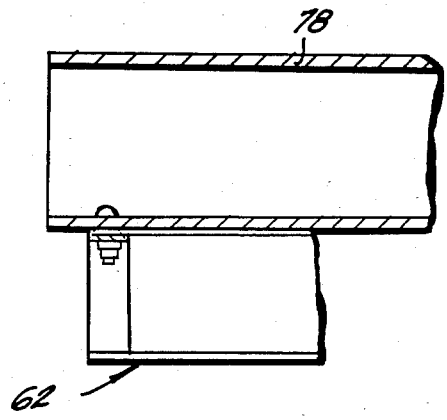
FIG. 14 is a side cross-sectional view of a portion of the section beam pallet shoe and arm, of the pallet of FIGS. 10 through 13.
Figure 15:
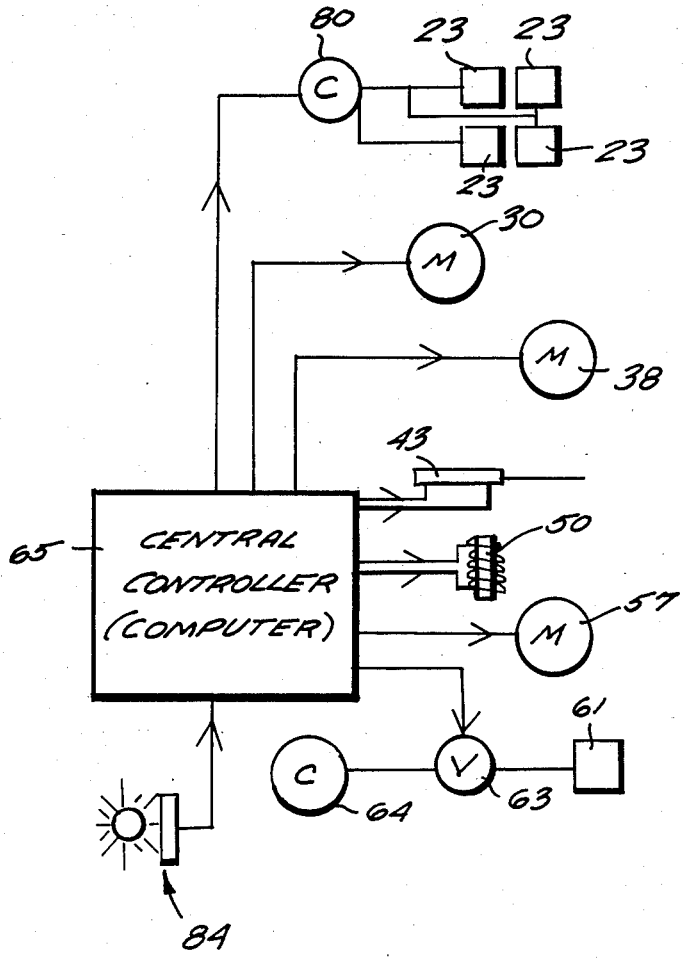
FIG. 15 is a schematic diagram illustrating the hookups of various components of the creel assembly according to the present invention to a central controller.

While the pivotal movement of the beams 51 about the pivot means 54 provides the gravitational impetus for allowing movement of section beam pallets therealong, in order to facilitate controlled pallet movement, suitable air bearing structures are also provided. The portion of the air bearing structures provided in association with the beams 51 comprise the contour top surface of the beams 51 defined by rail means 60, and air delivery means. While the rail means 60 are discernible in FIG. 4, they are most clearly illustrated in FIG. 13. Preferably the rail means 60 comprise the rail components of the commercially available air bearing system sold under the trademark "SailRail" by SailRail Corporation of Toronto, Canada. Rail means 60 comprise hollow sectioned beams with self-cleaning air nozzles 61 associated therewith for delivering air from the interior of the rails 60 to the volume between the rails 60 and the shoe means 62 of a cooperating pallet (as will be hereinafter described). The nozzles 61 are disposed at predetermined positions along the length of the rails 60, and are connected up through pulsating valves 63 to a compressor 64, the valves 63 being controlled by a central controller 65, as schematically illustrated in FIG. 15.

The exemplary section beam pallets according to the present invention are illustrated most clearly in FIGS. 4, and 10 through 14. An exemplary section beam pallet according to the present invention is indicated generally by reference numeral 68 in the drawings, and includes a conventional section beam 69 having a shaft 70 extending therethrough and defining an axis of rotation for the section beam 69. Frame means are provided for supporting the section beam 69 for rotation about the axis 70, and positioning the section beam 69 so that the axis defined by shaft 70 is essentially horizontal. The frame means include first and second side frame members 71 which each include (see FIGS. 10 and 12 in particular) a bottom tube 72 and a top arm means 73, connected together at the rear thereof by a rear support 74. The bottom tube 72 provides a journal means 76 for receipt of a bearing at the end of shaft 70. The rear support 74 is connected between vertically extending tubes 75 which span the member 72, 73.

Figure 4:
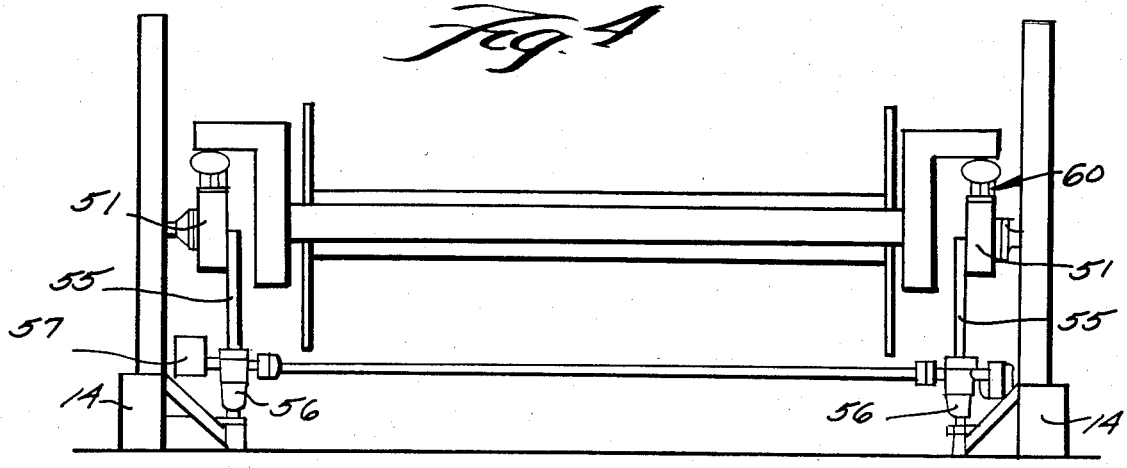
FIG. 4 is a sectional detailed view taken along lines 4—4 of FIG. 1.
Figure 10:
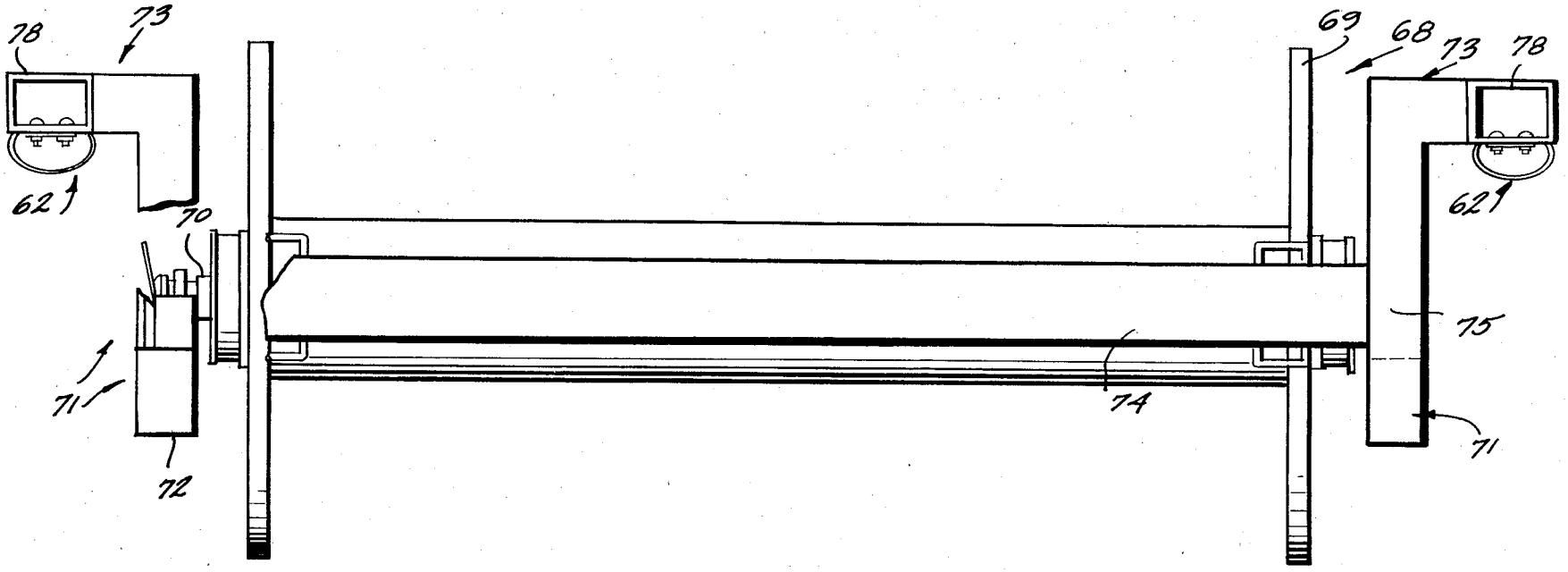
FIG. 10 is a front view, with some portions broken away for clarity of illustration, of an exemplary section beam pallet according to the present invention.
Figure 11:
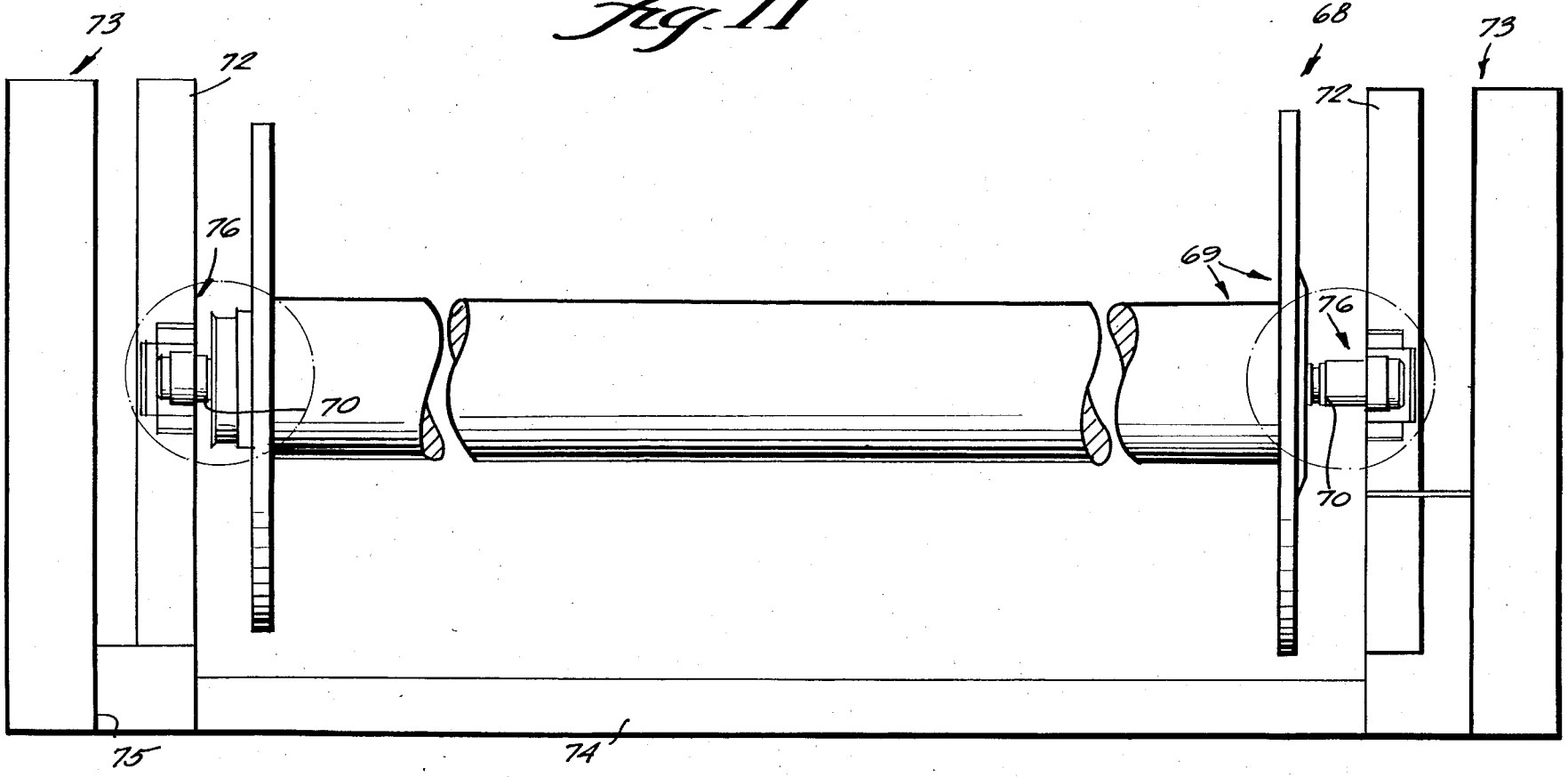
FIG. 11 is a top plan view of the pallet of FIG. 10.
Figure 12:
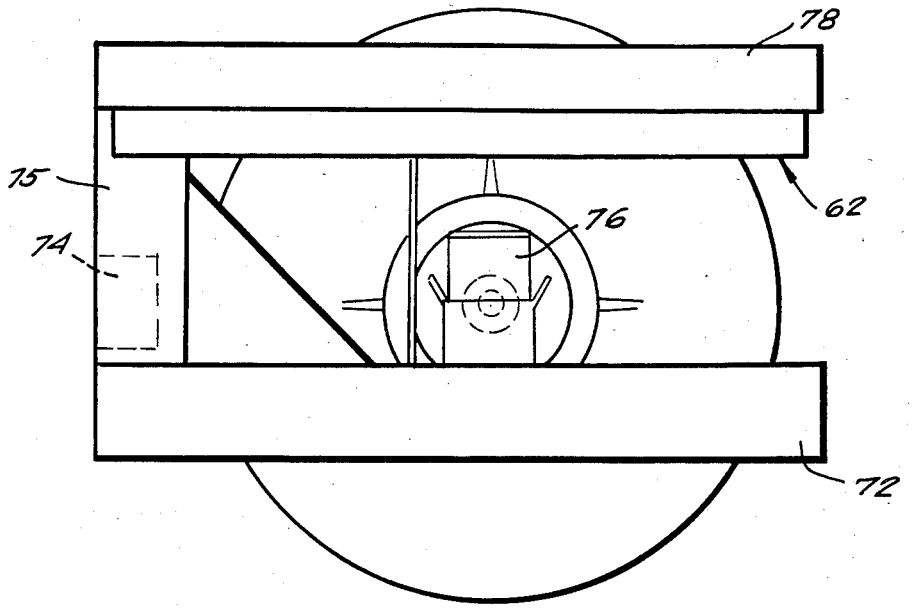
FIG. 12 is a side view of the pallet of FIG. 10.

As seen most clearly in FIGS. 4 and 10, the arm means 73 extend generally parallel to the horizontal axis defined by shaft 70, and are spaced from the axis a significant vertical distance (being above the axis). At the end of each arm means 73 is provided a hollow tube 78, the shoe means 62 being mounted to the bottom of the tube 78. The shoe means 62 is also a conventional component of the "SailRail" linear air bearing means discussed above, having an outer portion which is convex and cooperates with the top concave surface of the rail means 60.

The hollow tubes 78 are dimensioned so that the tines of a forklift, or an automated guided vehicle, may be inserted therein for lifting of the section beam pallet 68 during loading and unloading. Also the positioning of the journal means 76 and the end bearings of the shaft 70, as described above and as illustrated most clearly in FIGS. 10 through 12, ensures that the journals are remote from an operator, thus preventing the possibility that an operator's fingers may be inadvertently trapped thereby.

As previously alluded to, the central controller 65 (see FIG. 15) is capable of providing automatic control of all of the operable components of the creel assembly 10, including a compressor 80 for supplying compressed air to the air bearings 23. The controller 65 ensures automatic proper sequencing of all of the parts of the creel assembly.

Operation

Exemplary apparatus according to the present invention having been described, a typical method of operation thereof will now be set forth.

The creel assembly 10 is mounted, as illustrated in FIG. 5, so that the first creel 11 thereof is in operative association with the slasher 25. The sheet of yarn extending from each of the section beams of the first creel 11 leads to the slasher 25, passing from the first creel 11 through the first end 52 thereof. When one beam in the set of beams has been depleted, or fails to run acceptably, the slasher 25 is stopped and the sheet of yarn entering the the slasher is cut free from the creel assembly 10. The operator then signals that he is ready for the creel assembly to be rotated: i.e. the creel 12 may be brought into operative association with the slasher 25. Assuming that the loading of the second creel 12 is completed at that time, the creel assembly rotation sequence then begins.

Controller 65 operates solenoid 50 so as to retract locking pin 49 from the receptable 50', then controller 65 operates motor 30 to move the creel assembly 10 to the rotating position wherein it is concentric with the circle 27, and then the controller 67 activates the pneumatic cylinder 43 and the pneumatic motor 38 so that the wheel 40 is moved downwardly, against the bias of spring 46, and into contact with the floor 13 while the motor 38 rotates the shaft 39. The wheel 40 thus powers the creel assembly so that it rotates about the vertical axis defined by the rotating pin 20 at the center thereof, and when 180° of rotation has been completed the controller 65 automatically vents the pneumatic cylinder 43 so that the wheel 40 is moved upwardly, out of engagement with the floor 13, by the spring 46. Then the controller 65 operates the motor 30 to move the creel assembly 10 back to its operating position, in which position second creel 12 is now in operative association with the slasher 25, and a solenoid 50 is again operated to move its associated pin 49 into operative association with the receptacle 50'.

The slasher operator then relocates the hook reed (which will have already been prepared) from the second creel 12 to its operating position, and shortly thereafter the slasher will restart. Work then begins on unloading the depleted section beam pallets 68 from the first creel 11, and filling it with new pallets.

The operator removes any yarn remaining on the section beams 69 in the first creel 11. Then, either by an operator operating a forklift, or the controller 65 operating an automated guided vehicle (not shown) the unloading operation is begun. The upper section of the creel 11 is unloaded first, the controller 65 operating the motor 57' to ensure that the beams 51' and rails of the upper section are level. The unloading operation will be described with respect to the lower section, which includes the beams 51. Motor 57 is operated so that the beams 51 are level, and then the forklift tines are inserted into the hollow tubes 78 of the section beam pallet 68 which is closest to the first end 52 of the creel 11, and that pallet is then lifted and removed. Then the motor 57 is operated to pivot the beams 51 about the pivot means 54 so that they assume a downward slope (as illustrated in FIG. 1), and the controller 65 controls the pulsating valves 63 to control the supply of air under pressure through nozzles 61 to the volume between the rails 60 and the shoes 62. The pulsating supply of air and the downward slope of the beams 51 cause the next pallet to move downwardly (to the left in FIG. 1) to the first end 52 of the creel 11, until its position adjacent stop 82 (see FIG. 2) is detected by photocell 84 (see FIG. 15). Upon receiving a signal from photocell 84, the controller 65 then closes valve 63 and operates motor 57 to move the beams 51 back to the level position. The next pallet is then removed by the insertion of the forklift tines into the hollow tube 78 of that pallet 68. This operation continues until all of the pallets 68 have been unloaded from the creel 11.

After unloading of all of the pallets from the creel 11, loading then takes place, the lower section being loaded first, and then the upper section. The loading operation is essentially the reverse of the unloading operation, each pallet 68 being placed in association with the beams 51 while they are level, and then the beams 51 being pivoted about pivot means 54 by the motor 57 so that they slope downwardly from left to right in FIG. 1. The valves 63 are of course operated to facilitate the movement of the pallet 68 from left to right in FIG. 1 until all the pallets have been loaded.

Once both the upper and lower sections of the creel 11 have been loaded, the motor 57, and the corresponding motor 57' associated with the beams 51' of the upper section of the creel 11 (see FIG. 1), are operated so that the beams 51, 51' assume the position illustrated in FIG. 1, which is the running position of the creel, the yarn sheets from each of the section beams passing through the open end 52 of the creel 11. In this position, an operator connects a fixture to the creel that supports the hook reed, and the hook reed is attached. Then the operator secures the end of the sheet of yarn from a section beam and by unrolling the beam is able to move it to the hook reed. After laying in that sheet, the operator repeats the process until all the sheets of yarn have been placed in the hook reed. After the operator reconnects the tension device, he then signals that his duties are complete so that a subsequent rotation of the creel assembly 10 may be effected.

While the invention has been described primarily with respect to a slashing operation, it is to be understood that it can be utilized in any textile process wherein a number of section beams supply sheets of yarn. For instance, one typical such process is in denim operations where the section beams supply yarn to a sheet dyeing operation in which the yarns are dyed with indigo. Sometimes this process is combined with slashing subsequent to the dyeing operation.

It will thus be seen that according to the present invention an apparatus and method are provided which minimize creel downtime, facilitate creel loading and unloading, and facilitate automation of the entire creeling process.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. A creel assembly comprising:

first and second creels;

support frame means for supporting said first and second creels in side-by-side relationship, on a floor surface; and air bearing means for lifting said supporting frame means off said floor surface and positioning said frame means for rotation about a vertical axis disposed at the center of said frame means.

2. An assembly as recited in claim 1 further comprising means for effecting powered rotation of said frame means about said vertical axis while lifted off said floor surface by said air bearing means.

3. An assembly as recited in claim 2 further comprising means for horizontally linearly moving said supporting frame means between a first position, wherein said means for effecting powered rotation of said supporting frame means are not operable, to a second position at which said means for effecting powered rotation of said frame means are operable.

4. An assembly as recited in claim 2 further comprising pin latching for latching said frame means in a stationary position on said floor surface when supported on said floor surface.

5. An assembly as recited in claim 1 wherein said first and second creels each have upper and lower sections, each of said sections supporting a plurality of section beam pallets.

6. An assembly as recited in claim 5 wherein each of said upper and lower sections of each of said first and second creels comprises a pair of spaced beams which extend parallel to each other; means mounting said beams at one end thereof for pivotal movement about a horizontal axis; and power means for pivoting said beams about said horizontal axis so that said beams are movable from a true horizontal, level, position, to a position wherein said beams are not level and slope downwardly toward a first end of the creel with which said beams are associated.

7. An assembly as recited in claim 6 wherein said beams include upper surfaces comprising rail means for cooperation with section beam pallet shoe means, and air delivery means for delivering air between said rail means and pallet shoe means cooperating therewith.

8. An assembly as recited in claim 7 further comprising a plurality of section beam pallets mounted by each of said rail means, each section beam pallet including: a section beam; frame means for supporting said section beam for rotation about a horizontal axis, including first and second side members; said side members each including arm means extending generally parallel to said horizontal axis and elongated in a horizontal direction generally perpendicular to said horizontal axis; and pallet shoe means mounted to the bottom surface of each said arm means and elongated in said horizontal direction generally perpendicular to said horizontal axis, said shoe means cooperating with said rail means.

9. An assembly as recited in claim 8 wherein said section beam includes a shaft with bearings at the opposite ends thereof; and wherein said frame means side members include bearing means located at a central portion thereof for receipt of said shaft bearings for mounting said shaft for rotation about said horizontal axis, said bearings and bearing means being located remote from human operators, and operatively inaccessible by human operators while said section beam pallets are mounted on said creel assembly.

10. An assembly as recited in claim 9 wherein said arm means further comprise hollow tubes open at at least one end thereof and dimensioned for receipt of the tines of a transporting vehicle.

11. A creel assembly for holding loadable and unloadable section beam pallets comprising:

a supporting frame;

a pair of pallet supporting beams;

means for mounting said beams to said frame for pivotal movement about a horizontal axis;

power means for effecting pivotal movement of said beams about said horizontal axis between a level position in which said beams are essentially truly horizontal, to a non-level position wherein said beams slope toward a first end of said support frame; and said beams including upper surfaces comprising rail means for cooperation with pallet shoe means, and air delivery means for delivering air between said rail means and cooperating pallet shoe means.

12. An assembly as recited in claim 11 further comprising upper and lower sections, each of said upper and lower sections comprising: a pair of pallet supporting beams, including rail means; means for mounting said beams to a second end of said frame, opposite said first end, for pivotal movement about said horizontal axis; and a said power means.

13. An assembly as recited in claim 11 further comprising a plurality of section beam pallets mounted by each of said rail means, each section beam pallet including: a section beam; frame means for supporting said section beam for rotation about a horizontal axis, including first and second side members; said side members each including arm means extending generally parallel to said horizontal axis and elongated in a horizontal direction generally perpendicular to said horizontal axis; and pallet shoe means mounted to the bottom surface of each said arm means and elongated in said horizontal direction generally perpendicular to said horizontal axis, said shoe means cooperating with said rail means.

14. An assembly as recited in claim 13 wherein said section beam includes a shaft with bearings at the opposite ends thereof; and wherein said frame means side members include bearing means located at a central portion thereof for receipt of said shaft bearings for mounting said shaft for rotation about said horizontal axis, said bearings and bearing means being located remote from human operators, and operatively inaccessible by human operators while said section beam pallets are mounted on said creel assembly.

15. An assembly as recited in claim 13 wherein said arm means further comprise hollow tubes open at at least one end thereof and dimensioned for receipt of the tines of a transporting vehicle.

16. A pallet for a creel assembly, comprising:

a section beam;

frame means for supporting said section beam for rotation about a horizontal axis, said frame means including first and second side members;

said side members each including arm means extending generally parallel to said horizontal axis and elongated in a horizontal direction generally perpendicular to said horizontal axis; and pallet shoe means mounted to a lower surface of said arm means and elongated in said horizontal direction generally perpendicular to said horizontal axis.

17. A pallet as recited in claim 16 wherein said arm means are positioned a significant distance above said horizontal axis, and the lower surfaces of the pallet shoe means associated with each of said arm means are disposed in a horizontal plane parallel to said horizontal axis.

18. A pallet as recited in claim 16 wherein said section beam includes a shaft with bearings at the opposite ends thereof; and wherein said frame means side members include bearing means located at a central portion thereof for receipt of said shaft bearings for mounting said shaft for rotation about said horizontal axis, said bearings and bearing means being located remote from human operators, and operatively inaccessible by human operators while said section beam pallets are mounted on said creel assembly.

19. A pallet as recited in claim 16 wherein said arm means further comprise hollow tubes open at at least one end thereof and dimensioned for receipt of the tines of a transporting vehicle.

20. A method of supplying yarn from a plurality of section beams mounted on a creel assembly, to a structure for acting upon yarn, the creel assembly including first and second creels disposed in side-by-side relationship, and the method comprising the steps of:

(a) mounting the creel assembly so that yarn from all the section beams in the first of the creels is in operative position with the machine for acting upon the yarn;

(b) loading the second creel with section beam pallets while yarn is being taken from section beam pallets of the first creel;

(c) after yarn supply from one or more section beams of the first creel are exhausted, cutting the sheet of yarn from the entire first creel, and then lifting the creel assembly off the floor and rotating it 180° to a position wherein the section beams of the second creel are in operative position with the machine for acting upon the yarn;

(d) operatively connecting the yarn sheet from all of the section beams of the second creel to the machine for acting upon the yarn; and (e) repeating steps (a)–(d) as the yarn supply from each of the creels is exhausted.

21. A method as recited in claim 20 wherein each of the first and second creels comprises beams which are mounted for pivotal movement about a horizontal axis at a second end of each of the creels; and wherein step (b) is practiced by removing a first section beam pallet from the beams while they are in a level, horizontal position; pivoting the beams about a horizontal axis so that they are inclined downwardly from the second end to the first end thereof to allow another section beam pallet to move to the end of the beams at the first end of the creel; pivoting the beams about the horizontal axis so that they are again level and then removing the next section beam pallet from the first end of the creel; and repeating the steps until all section beam pallets have been removed from the creel; and then loading the beams with new section beam pallets.

22. A method as recited in 21 wherein each creel includes upper and lower sections, each section including a pair of pivotally mounted beams; and wherein the upper section of each creel is unloaded first, and then the lower section; and the lower section of each creel is loaded first, and then the upper section.

* * * * *